United States Patent [19]

Mellard

[11] 4,313,452

[45] Feb. 2, 1982

[54] SELF-ACTUATING VARIABLE RATE WATER PIPE BLEEDER

[76] Inventor: George K. Mellard, 8905-238th St., SW., Apt. 17, Edmonds, Wash. 98020

[21] Appl. No.: 180,983

[22] Filed: Aug. 25, 1980

[51] Int. Cl.[3] ..... E03B 7/12

[52] U.S. Cl. ..... 137/62; 137/79; 237/80

[58] Field of Search ..... 137/59, 60, 62, 79, 137/80, 301, 302, 344, 375; 237/80

[56] References Cited

U.S. PATENT DOCUMENTS

| | | | |
|---|---|---|---|
| 956,062 | 4/1910 | Fell | 137/60 |
| 1,971,459 | 8/1934 | McGuire | 137/60 |
| 3,369,556 | 2/1968 | Allderdice | 137/62 |
| 3,380,464 | 4/1968 | Arterbury et al. | 137/60 |
| 3,511,253 | 5/1970 | Ljutov | 137/60 |
| 3,618,625 | 11/1971 | Walters | 137/62 |

*Primary Examiner*—George L. Walton
*Attorney, Agent, or Firm*—Cole, Jensen & Puntigam

[57] ABSTRACT

The pipe bleeder includes a small holding tank and a sample tube, both of which are filled with water and exposed to the ambient atmospheric temperature. The water in the sample tube freezes first when the ambient temperature is at freezing, which in turn causes a piston and then a push rod in the sample tube to move, the top of the push rod acting against a small cover plate in the holding tank, moving it away from a drain connection. When the cover plate is so moved, water from the water supply pipe will flow at a relatively slow but steady rate through the drain connection to the environment, maintaining a flow of water through the supply pipe and thus preventing the water in the water supply pipe upstream of the pipe bleeder from freezing. An exterior thaw tube is also attached to the drain connection in the holding tank. When the ambient temperature increases to a few degrees above freezing, the ice in the thaw tube will thaw, resulting in a spray of water from the end of the thaw tube, which is directed into an interior thaw tube which is inside the sample tube, thawing the ice in the sample tube. The thawing of the ice in the sample tube results in the piston and the push rod retracting and the cover plate moving back into place, closing off the drain opening.

7 Claims, 4 Drawing Figures

SELF-ACTUATING VARIABLE RATE WATER PIPE BLEEDER

BACKGROUND OF THE INVENTION

This invention relates generally to devices which prevent water in water supply pipes from freezing, and more specifically concerns such a device which is designed to prevent such freezing by providing a constant flow of water through the water supply system when the ambient temperature drops below freezing.

Freezing ambient temperatures will cause the water in water supply pipes to freeze, with subsequent water and pipe damage and interruption of water service. This is particularly true where a portion of the water supply pipe is above ground, such as is found typically in a recreational vehicle park, mobile home park, or campground, where the water supply pipes extend above ground, and a connecting pipe, such as a hose, which is exposed to the environment, is used to connect the standpipe to the vehicle or residence. The water in the exposed connecting pipe is particularly vulnerable to freezing and may do so even at moderately freezing temperatures, right at or slightly below freezing.

One solution is to wrap the pipes with a thermally insulating material. However, the connecting pipe used for most recreational vehicles and campground facilities is flexible hose, for which thermal wrapping is ineffective. Furthermore, such hoses and their connections are usually subject to leaking, which in turn will cause the wrapping itself to become soaked with water which in turn will freeze.

In another solution, a heating strip is used to maintain the pipe above freezing temperatures with electrical energy. However, such devices can be quite expensive, are somewhat unpredictable in operation, require maintenance, and can be quite dangerous, due to the possibility of electrical shock.

In still another solution, a faucet on the water supply pipe is permitted to drip, so that a small amount of water is continuously passed through the water supply system. However, temperatures substantially below freezing will most likely cause the pipe servicing the dripping faucet to freeze anyway, and the sound of a constant drip is irritating.

Accordingly, it is an object of the present invention to provide an apparatus for preventing water pipes from freezing which overcomes one or more of the disadvantages of the prior art noted above. The apparatus is directed specifically toward solving the problem of the freezing of water in connecting pipes which extend from a supply pipe to service recreational vehicles, in campgrounds and the like.

It is another object of the present invention to provide such a device which is self-actuating, following closely the ambient temperature so that it actuates when the ambient temperature reaches freezing, and reverts to an inactive state when the ambient temperature increases to a few degrees above freezing.

It is a further object of the present invention to provide such an apparatus which is automatic in operation, and does not need to be reset.

It is an additional object of the present invention to provide such an apparatus which does not pollute the water supplied by the standing supply pipe.

It is yet another object of the present invention to provide such an apparatus which requires relatively little maintenance.

It is a still further object of the present invention to provide such an apparatus which requires no electrical energy for operation.

It is another object of the present invention to provide such an apparatus which may be quickly and conveniently installed by a user.

It is an additional object of the present invention to provide such an apparatus which may be used with a variety of sizes of connecting pipe.

SUMMARY OF THE INVENTION

Accordingly, the present invention is an apparatus for preventing water in water supply pipes from freezing, wherein the apparatus includes sample chamber means, such as an elongated tube, which is filled with water and exposed to the environment. A drain means has an opening therethrough so that it can receive water from a water supply pipe at one end thereof and discharge it to the environment at the other end thereof. Means are provided for selectively closing off the opening in the drain means to prevent the drain means from discharging water from the supply pipe to the environment. The opening is closed by the closing means when the water in the sample chamber means is not frozen. The apparatus further includes means for operating on the closing means to expose the opening in the drain means to water from the supply pipe in response to the water present in the sample chamber means freezing, and means deliverying water from the water supply pipe to the opening in the drain means when the opening is exposed by the action of the operating means. This results in a flow of water through the water supply pipe and out the drain means to the environment for so long as the water in sample chamber means remains frozen. This flow of water tends to prevent the water in the water supply pipe from freezing.

DESCRIPTION OF THE DRAWINGS

A more thorough understanding of the invention may be obtained by a study of the following detailed description taken in connection with the accompanying drawings in which.

DESCRIPTION OF THE PREFERRED EMBODIMENT

Figure 1:
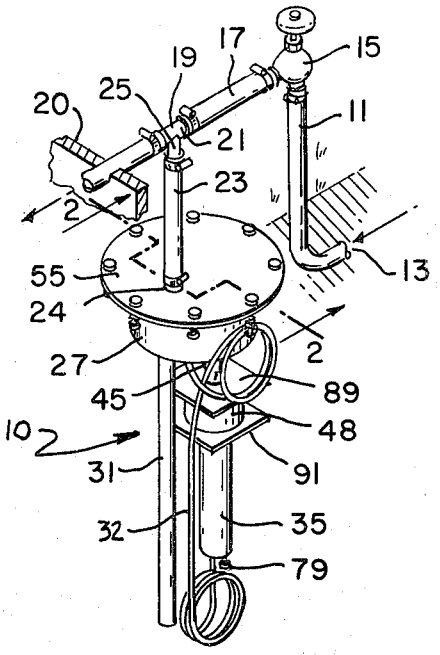
FIG. 1 is a simplified diagrammatic view of the apparatus of the present invention, showing the manner in which it is connected to an existing water supply system.
Figure 2:
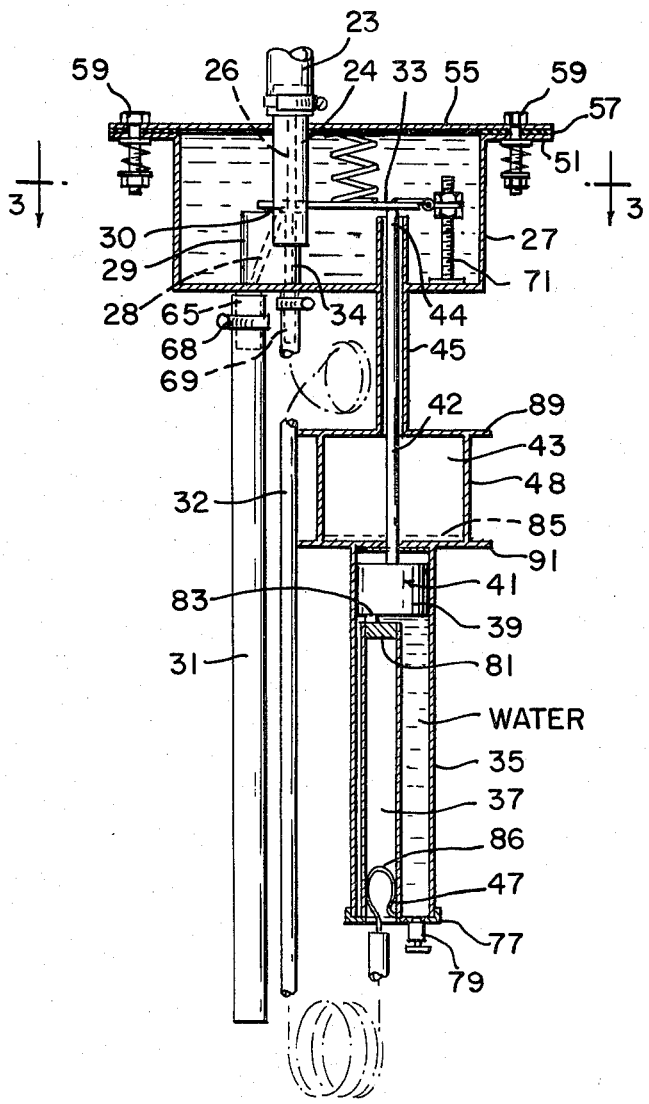
FIG. 2 is a partial cross-section elevational view showing the apparatus of FIG. 1.
Figure 3:
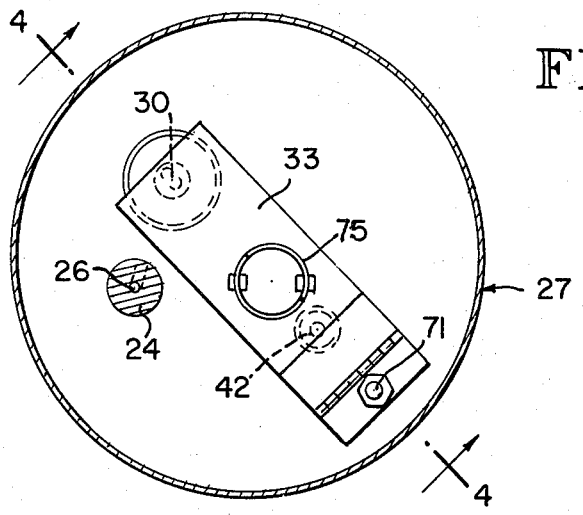
FIG. 3 is a cross-sectional view taken along lines 3—3 in FIG. 2.
Figure 4:
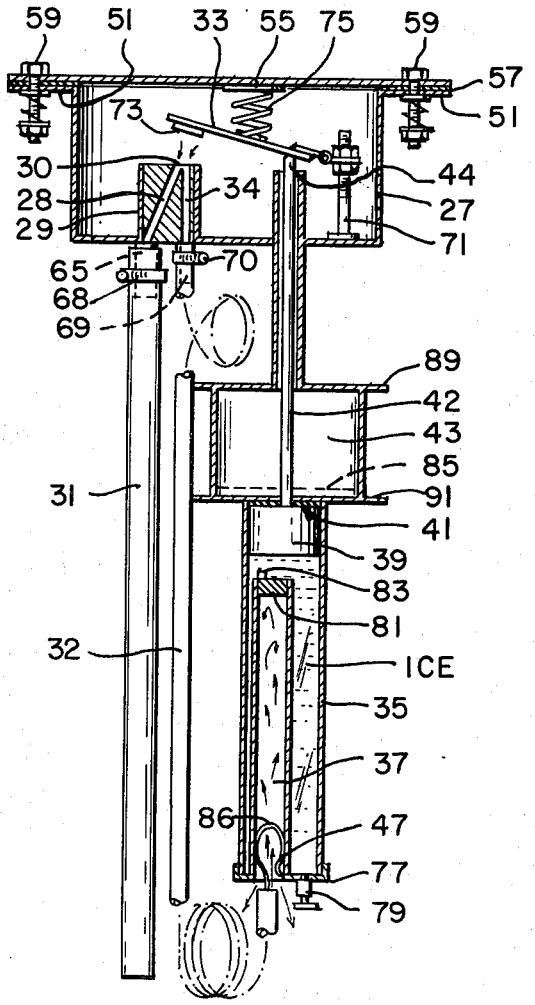
FIG. 4 is a partial cross-sectional elevational view similar to that of FIG. 2, showing the position of the component parts of the apparatus when it has been activated.

In FIG. 1, the pipe bleeder apparatus of the present invention, referred to generally at 10, is shown in a typical environment, while FIGS. 2, 3 and 4 show the major components of the apparatus. A standpipe 11 is the exposed termination point for a buried water supply pipe 13. Standpipes, with a faucet 15 or similar shutoff device, are common at recreational vehicle parks, mobile home parks and campgrounds. The user connects the standpipe 11 to his vehicle through a connecting hose 17 which typically is at least several feet in length and may be as much as 100 feet. In freezing weather, the stationary water in the connecting hose 17 freezes rapidly, shutting off the water supply to the user.

The pipe bleeder 10 of the present invention is connected between connecting pipe 17 and the user just before the user's installation, such as a vehicle, through a T-shaped connector 19. The connector 19 typically will abut the exterior wall 20 of the user's vehicle. The connecting pipe 17 is connected to one leg 21 of the connector 19, while a hose 23 connects the stem 25 to the apparatus 10. A small length of pipe connects the other leg of the connector to the user's water system in his vehicle.

In very general terms, the apparatus 10 includes a small holding tank 27 to which is supplied water from hose 23 through a filler tube 24, which has a small channel 26 in it. Channel 26 is right angled at its lower end so that it exits through the side of filler tube 24. Upstream of the filler tube 24 could be located, if necessary, a filter (not shown) to filter out small stones, etc. from the supply water.

A pedestal drain element 29 is positioned at the bottom of holding tank 27, and has two longitudinal drain channels, one channel leading to an exterior drain pipe 31 and the other leading to an exterior thaw tube 32. The two longitudinal channels share a common drain opening 30 at the top of the pedestal drain element. A small upstanding ring (not shown) extends upwardly around the opening 30 in the drain element. A hinged cover plate 33 abuts the ring, covering the opening when the apparatus is in its non-activated state. When cover plate 33 is positioned down against the upstanding ring on pedestal drain element 29, the water from the standpipe flows conventionally through connecting pipe 17 and T-shaped connector 19 into the user's vehicle or similar device.

The apparatus 10 further includes a sample tube 35 which includes an interior thaw tube 37. The head portion 39 of a piston-like combination 41 rests against a stub 83 on the top of the interior thaw tube 37. The push rod portion 42 of the piston combination, which is not connected to the head portion 39 but rests against it, extends upwardly through a rubber isolation member 43 and a guide tube 45 into holding tank 27 against the bottom of hinged cover plate 33. The bottom of the exterior thaw tube 32 is positioned close to the open bottom of interior thaw tube 37 by a wire 47 leading from the exterior thaw tube, for reasons explained more in detail hereinafter.

When the ambient temperature drops to freezing or below, the water in the exterior thaw tube 32 will quickly freeze first. The water in the sample tube 35 will also quickly begin to freeze. The expanding ice in sample tube 35 forces piston combination 41 upwardly, with the floating push rod 42 rotating hinged cover plate 33 upwardly off of the annular ring on the pedestal drain element 29, exposing the common drain opening 30 in the top of the pedestal drain element. Water in the holding tank, as well as water from the water supply system, moving through connecting pipe 17, hose 23 and channel 26 in filler tube 24 flows into the common opening 30 in the pedestal drain element and then out drain pipe 31, thus maintaining a flow of water in the water supply system upstream of the apparatus, preventing freezing of the water in the upstream portion of the system thereby.

When the ambient temperature increases, up to several degrees above freezing, the ice in the exterior thaw tube 32 will thaw first. Water entering the common opening in pedestal drain element 29 from the water supply system, through holding tank 27, will then move under pressure through the exterior thaw tube 32, out the end thereof, and then up into interior thaw tube 37 in sample tube 35. This will hasten the thawing of the ice in sample tube 35; when the ice therein melts, the piston combination 41 will drop down to its ready position, permitting hinged cover plate 33 to move back down on the annular ring on the top of pedestal drain element 29, closing off the common drain opening 30. Normal operation of the water supply system, with water moving uninterruptedly directly from standpipe 11 through connecting pipe 17 into the user's installation, then occurs.

Referring now to FIGS. 2 and 3 in detail, the holding tank 27 in the embodiment shown is made of copper, and is circular in configuration, having a 4-inch inside diameter, with a circumferential wall 2 inches high and 1/16th inch thick. A one-inch flange 51, of galvanized iron, is welded to the top edge of holding tank 27 and extends outward perpendicularly from the circumferential wall thereof. Eight openings are provided in flange 51, uniformly spaced around the circumference thereof. The holding tank 27 includes a lid 55 of galvanized iron. The lid is six inches in diameter, so that its outer edge mates with the outer edge of flange 51. Positioned between flange 51 and lid 55 is a rubber gasket 57. Lid 55 and gasket 57 also have a plurality of openings, spaced so that the respective openings in flange 51, lid 55 and gasket 57 are in registry.

A plurality of nut, bolt and spring combinations 59, one for each opening, secure lid 55 to flange 51 and hence the remainder of holding tank 27. The springs are tensioned in the embodiment shown to approximately 125 lbs., which is industrial pressure, so that lid 55 will separate from flange 51 in the event that the water in the holding tank completely freezes, thereby preventing damage to the holding tank caused by expansion of the freezing water in the holding tank. The combinations 59 could of course be adjusted to other desired tensions.

Filler tube 24 extends through lid 55 from above. Hose 23 from the T-shaped connector 19 is clamped to the portion of filler tube 24 which extends above lid 55. Filler tube 24 extends down into the interior of sample tank 27 approximately $1\frac{1}{4}$ inches. Filler tube 24 in the embodiment shown is a copper tube having an inside diameter of $\frac{1}{2}$ inch, and is filled with waterproof epoxy, with the exception of filler channel 26. Filler channel 26 is 3/32nd inch in diameter and extends from the top of the filler tube down through the center of tube 24 to a point which is 1 inch from the lower surface of lid 55, where it takes a right angle and exits out the side wall of the filler tube. The opening in the side wall is located such that water exiting from the opening is aimed at the common drain opening 30 in the pedestal drain element 29. The size of channel 26 may be varied, depending on the rate of flow out drain pipe 31 desired. In the embodiment shown, plugs are provided for the filler tube 24 which have different size openings.

Pedestal drain element 29 is a copper tube approximately 1 inch high, with a $\frac{3}{4}$ inch inside diameter. Pedestal drain element 29 is also filled with waterproof epoxy and has the two drain channels 28 and 34 formed therein. Drain element 29 is secured to the bottom of holding tank 27. The top of drain element 29 is above the bottom surface of the holding tank to prevent ice forming at the bottom of the tank from freezing over opening 30. The two small diameter drain channels 28 and 34 originate in a common drain opening 30 at the top of the drain element. One drain channel 28 extends at an angle, approximately 45° C. in the embodiment shown, downwardly through the drain element 29, terminating in a first drain stub 65 which depends from the bottom of holding tank 27. The second drain channel 34 extends straight downwardly through the drain element 29, terminating in a second drain stub 69 which also depends from the bottom of sample tank 27.

The size of the drain channels, particularly the size of drain channel 28, helps determine the rate of water flow through the apparatus in its operative, freeze-prevent configuration. The size of this channel and the size of the filler channel may be varied to increase or decrease the rate of water flow. Again, in the embodiment shown, the size of the channels may be varied by changing plugs fitted to the filler tube and drain elements, respectively, with different size channels formed therein. The position of the filler tube relative to the position of the pedestal drain element in the holding tank 27 is shown most clearly in FIG. 3. When hinged cover plate 33 is pushed up, by the action of the free-floating push rod 42, the common opening 30 in the top of the pedestal drain element is exposed and water from filler channel 26 in filler tube 24 flows across a small gap into the opening 30, thereby facilitating a rapid movement of water through the system. The flow of water from filler tube 24 also causes a slight swirling of the water in holding tank 27, tending to prevent formation of ice on the walls of the holding tank. The filler tube and the drain element are positioned so that there is a minimal distance between the lower end of the filler channel 26 and the common opening 30 in the drain element 29.

Extending upwardly from, and secured to, the bottom of holding tank 27 is a support stand 71, in the form of a threaded rod. The support stand in the embodiment shown is $1\frac{1}{2}$ inches high and has a diameter of 3/16th inch. The base of the hinged cover plate 33 is secured to support stand 71 by a pair of nuts, with lockwashers, threaded onto, and then soldered to, the support stand 71. The remainder of the cover plate is hinged to the base, and thus rotates vertically about the hinge. At the other end of hinged cover plate 33 is a rubber disc 73 which fits against the annular ring (not shown), covering the common drain opening 30 in the pedestal drain element 29, when the device is in its non-freeze mode, thus blocking any water from the opening 30. The hinged cover plate itself in the embodiment shown extends just over the opening 30, so that it does not extend even to the edge of the drain element 29. This arrangement tends to prevent ice from forming between the end of the cover plate 33 and the wall of the holding tank. Connected to the top of hinged cover plate 33 is a spring 75 which bears against the undersurface of lid 55 when the lid is in place on holding tank 27. The hinged cover plate 33 is forced downwardly by the action of spring 75, so that rubber disc 73 is biased firmly against the annular ring on top of the pedestal drain element when the device is in the non-freeze mode.

The sample tube 35 in the embodiment shown is made of copper, is 5 inches high with a 1 inch inside diameter and a wall $\frac{1}{8}$ inch thick. The interior thaw tube 37 is made of brass, is 4 inches long and has a $\frac{1}{2}$ inch inside diameter with a 1/16th inch thick wall. The open bottom end of the interior thaw tube 37 is coincident with the bottom of sample tube 35 and is open to the atmosphere, so that the interior of interior thaw tube 37 is open to the atmosphere. The interior thaw tube may be secured to the sample tube along its length by soldering or the like. Secured to the bottom of sample tube 35, and extending a short distance up the outside thereof, is a copper cap 77, which has an opening therein which is in registry with the bottom end of interior thaw tube 37. Cap 77 helps to strengthen the sample tube structure. A bleeder valve 79, similar to that found on automobile radiators, is provided in cap 77 and connects the interior space between the interior thaw tube and the sample tube with the atmosphere. Bleeder valve 79 is normally closed, except when the system is to be put into operation, or cleaned, as described in more detail hereinafter.

The top of interior thaw tube 37 is closed with a cap 81. Cap 81 is secured by soldering to the interior surface of the interior thaw tube 37. The top surface of cap 81 is level with the top edge of interior thaw tube 37. Extending from the upper surface of cap 81, $\frac{1}{8}$ inch from the interior surface wall of sample tube 35, is a small upstanding rod-like stub 83. The head 39 of piston combination 41 rests on stub 83 when the device is in its non-freeze mode. The height of stub 83 is significant, as it has been found by the inventor that the speed of, and the total rise of, the piston combination 41, and hence hinged cover plate 33, is dependent upon the height of stub 83, for a given temperature. In the embodiment shown, the stub is $\frac{1}{8}$ inch high and $\frac{1}{8}$ in diameter and is made of brass. In the embodiment shown, the length of the hinged cover plate is such that the vertical distance between the hinged cover plate and the drain element is approximately twice the rise of the push rod.

The strength of the sample tube 35 may be increased, if necessary, by one or more clamps (not shown) spaced along its length. This will provide additional lateral support for the sample tube during the expansion of the water in the sample tube as it turns into ice.

The piston head 39 in the embodiment shown is made of solid metal, such as zinc, is $\frac{3}{4}$ inch high and has a diameter of 31/32 inches, so that it fits within the volume in the sample tube between stub 83, approximately to the top of the sample tube. There is still room, however, for a thin sheet of water to be present at the side surface of the piston head. The expansion of the water in the sample tube caused by freezing forces the piston head 39 upwardly. Extending upwardly from the upper surface of piston head 39 is the push rod 42, which is made of iron or steel, $\frac{1}{8}$th inch in diameter and $4\frac{1}{2}$ inches long. As mentioned above, the lower end of push rod 42 rests or "floats" on the upper surface of piston head 39, but is not attached thereto. The upper end 44 of push rod 42 bears against the undersurface of hinged cover plate 33 in holding tank 27.

Push rod 42 extends through the center of isolation member 43, which comprises a block of silicone rubber averaging $1\frac{7}{8}$ inches in diameter and $1\frac{3}{8}$ inches high. Isolation member 43 is surrounded by a metal wall 48 and upper and lower heat sink plates 89 and 91, which are each 4 inches by 5 inches by 1/16 inch thick. The heat sink plates 89 and 91 and the isolation member 43 help to thermally isolate the sample tube 35 from the water in the holding tank 27. The isolation member 43 includes a small groove 85 across its bottom surface, adjacent the top surface of the piston head 39. In the embodiment shown, the groove 85 extends completely across the bottom surface of the element, through the central axis of the member, and is approximately ⅛ inch deep and 3/16 inch wide. Groove 85 permits free passage of water into the sample tube during thawing of the device as well as during bleeding. A similar groove could also be positioned in the top surface of the isolation member.

Guide tube 45 is connected between the upper heat sink plate 89 and the bottom of holding tank 27. Guide tube 45 in the embodiment shown is made from galvanized iron, 3 inches long, with a ¼ inch inside diameter and a 1/16th inch thick wall. The floating push rod 42 extends from the piston head 39 through isolation member 43, through guide tube 45, into holding tank 27, against the undersurface of hinged cover plate 33. The guide tube 45 must have a sufficient inside diameter relative to the diameter of the push rod that the guide tube, and hence the push rod, do not freeze solid before the piston head and the push rod have been raised by the action of the freezing water in the sample tube 35. The length of the guide tube also helps to thermally isolate the sample tube from the warmer water in the holding tank, so that the water in sample tube 35 will in fact freeze closely after the ambient atmospheric temperature reaches freezing.

In the embodiment shown, a drain pipe 31 is secured to the first drain stub 65 and drains off the flow of water through the device when the device is in its freeze mode. Drain pipe 31 is made of plastic, has a ½ inch inside diameter and is approximately 10 inches long. It is secured to the stub 65 by means of a clamp 68.

Connected to the second drain stub 69 by means of a clamp 70 is the exterior thaw tube 32. Exterior thaw tube 32 in the embodiment shown is also plastic, has a 3/16 inside diameter and is about 38 inches long. The thaw tube 32 is coiled in an advantageous configuration as shown most accurately in FIG. 1. Referring to FIG. 1, the tube 32 curves upwardly from drain stub 69 and forms 1½ loops beside, but not touching, the body of the holding tank 27. These loops are typically tied to one of the nut/bolt/spring combinations 59 in the flange portion of the holding tank. FIGS. 2 and 4 show the upper 1½ turns representationally, for drawing clarity; the location of the turns in the embodiment shown are as shown in FIG. 1. The exterior thaw tube then depends downwardly and terminates below the bottom of sample tube 35, where it is coiled for 3 turns in small diameter loops, as shown. This configuration insures that there will be water in the thaw tube at all times, in its non-freeze mode, regardless of the orientation of the apparatus.

At the lower end of exterior thaw tube 32 is inserted a ⅛ inch diameter wire 47 which extends back up into the exterior thaw tube for a distance of approximately 6 inches. Thus, over its approximately last 6 inches, the exterior thaw tube 32 has a free interior diameter of only 1/16th inch. A small hook 86 is formed in the exposed end of wire 47 and this hook 86 is positioned in the lower end of interior thaw tube 37, bearing against a small lip on the interior surface thereof, where it holds the lower end of exterior thaw tube 32 slightly away from but facing the open end of interior thaw tube 37, so that water flowing through the exterior thaw tube 32 will spray up inside the interior thaw tube 37.

In use, exterior thaw tube 32 is first filled with water via pipe 31 and drain channels 28 and 34. The apparatus is then bled to remove air, by upending the apparatus, connecting a source of water to the exterior portion of filler tube 24, and opening bleeder valve 79, until the flow of water out the bleeder valve contains no bubbles. Some air, however, will remain in the apparatus, particularly the holding tank, and this acts to help take up the expansion of the water, should the entire apparatus freeze.

In operation, when the ambient temperature reaches freezing or below, a thin layer of water around piston 41 will freeze first, sealing off sample tube 35 from the remainder of the apparatus. The water in the exterior thaw tube 32, particularly the lower portion with the wire 47 therein, will also freeze fast. Typically, a one inch section of frozen water in exterior thaw tube 32 is sufficient to block water from flowing out the thaw tube 32. The water in the sample tube will then freeze, upwardly from the bottom end and from the inside surface inwardly, compressing the sealed off central core of the water in the sample tube. The fast freeze tracking of the water in the sample tube is enhanced by the thermal isolation between the sample tube and the water in the tank, provided by the rubber isolation element 43, the guide tube 45 and the heat sink plates 89 and 91. Hence, the commencement of freezing of the water in the sample tube follows rapidly the freezing atmospheric temperature.

During the initial stages of freezing, when the ice in the sample tube is forming, and the ice around piston head 39 has formed, a lump of ice will form between stub 83 and the interior surface of the sample tube, extending upwardly from the stub. This lump of ice will assist in initially moving the piston combination 41 up slightly, through the surrounding sleeve of ice. As the water in sample tube 35 continues to freeze, the piston combination will continue to rise, until it reaches its highest position, when the water in sample tube 35 is completely frozen. The piston combination remains in this position until the ice in the sample tube 35 melts, due to rising temperatures. The upward movement of piston combination 41 dislodges any ice on the lower surface of the isolation member. Further, this upward action of piston combination 41 compresses slightly the silicone rubber isolation member 43, and any slush or water above the isolation member is forced back up into the holding tank via guide tube 45.

The floating push rod 42 moves up correspondingly, forcing the hinged cover plate 33 upwardly against the bias action of spring 75, which results in the exposure of the common drain opening 30 in the top of pedestal drain element 29. Water from the supply system, through the filler channel 26 in filler tube 24, then begins to flow into the common drain opening 30 and out through drain pipe 31, but not through exterior thaw tube 32, which is frozen.

A continuous flow of water through the system upstream of the apparatus is thus maintained, and every portion of the system upstream of the apparatus is helped because cold water is removed therefrom through the action of the apparatus. Hence, should the ambient temperature fall very low, such as 20° below zero, which would risk freezing of even buried supply pipes, freezing may be prevented by maintaining the flow of water through the entire supply system.

When the water in sample tube 35 freezes solid, the maximum rise of hinged coverplate 33 will result, because piston 41 has moved vertically its full distance. The draining of water through the apparatus continues for as long as cover plate 33 is held up. As mentioned above, the height of the stub 83 determines to an extent the speed and height of the rise of the coverplate. Also, the amount of the flow of water through the apparatus is determined primarily by the size of the channel 26 in filler tube 24 and channel 34 in drain element 29.

It is well known that ice takes a substantial amount of time to thaw, if the ambient temperature remains at or a few degrees above freezing. This principle is used to advantage in the apparatus of the present invention. As the ambient temperature rises slightly above freezing, the ice in the apparatus begins to melt; however, it does not melt immediately, thereby shutting off the drain opening 30. This is advantageous because the supply pipe or connecting pipe are still susceptible to freezing due to frozen earth or the effects of the wind chill factor. Thus, the apparatus is designed to thaw relatively quickly only when the atmospheric temperature reaches 37° F., or thereabouts.

To conserve water, and prevent unnecessary prolonged draining, thawing is assisted by exterior thaw tube 32. As mentioned above, the thaw tube 32 has a 3/16th inch bore at the upper end, which is connected to drain stub 69, but only an effective 1/16th inch bore at the free lower end, due to the presence of the ⅛th inch wire 47. The lower end of the exterior thaw tube 32 thus thaws quickly and also freezes quickly, which provides a fast refreezing of the apparatus and reopening of the drain opening 30 should the ambient temperature, after only a short period of thaw, again go below freezing. Thus, the primary purpose of the 3/16th inch diameter upper portion, which freezes solid during a prolonged freeze, is to place a delay on the thawing of the exterior thaw tube 32, providing a longer draining of the colder supply and connecting pipes.

However, should the ambient temperature remain at 37° F. for a reasonable amount of time, both the lower end and the upper end of the exterior thaw tube will thaw, providing another drain from the holding tank 27. This water in exterior thaw tube 32, under pressure, will flow out from the lower end of thaw tube 32, and will spray up inside at least a portion of interior thaw tube 37, generally as shown by the arrows in FIG. 4. The free end of exterior thaw tube 32 is held close to, but not abutting, the interior thaw tube 37 by wire loop or hook 86. This arrangement keeps the exterior thaw tube at a sufficient distance from the holding tube so that any mere dripping from the holding tank through the exterior thaw tube will not contact the sample tube, which would upset the freezing action of the sample tube. Any such dripping from the exterior thaw tube 32 thus falls away from the sample tube.

The spray of water from exterior thaw tube 32 into interior thaw tube 37 warms the wall of the interior thaw tube, assisting in quickly thawing the ice in sample tube 35. The ice in the sample tube will continue to melt; the final portion to melt is between the bottom surface of piston head 39 and the top of interior thaw tube 37. When this portion melts, the piston combination 41 moves downwardly to its ready, non-freeze position, in which piston head 39 rests on the top of stub 83. This is an efficient sequence of freezing and thawing, in that all of the ice in sample tube 32 melts before piston head 39 drops down, which insures maximum efficiency for the next following rise of the piston.

The biasing action of spring 75, which tends to force hinged cover plate 33 downwardly, also assists in this action, particularly when the ice in the sample tube is in the last stages of thawing. When the hinged cover plate 33 returns to its closed position, the rubber disc 73 once again bears against the top of the annular ring (not shown) covering the common drain opening 30 in the top of pedestal drain element 29 and closing off the exit of water from holding tank 27.

The apparatus is now in its ready, non-freeze mode. It requires no reset operation and is ready, as soon as the ambient atmospheric temperature drops to freezing or below again, to repeat the operation described above. Hence, the apparatus is capable of continually recycling, without having to be manually reset. It also closely follows the ambient temperature in operation, by opening a drain pipe when the atmospheric temperature reaches freezing, and closing the drain pipe when the temperature rises several degrees above freezing.

Thus, the present invention utilizes a characteristic of freezing water, i.e. physical expansion, in order to control mechanical elements which in turn operate to prevent the water supply system from freezing, by maintaining a constant flow of water through the system. The apparatus removes freezing or near freezing water from the water supply pipe system upstream of the apparatus, i.e. between the apparatus and the water supply, and replaces this water with warmer water from a protected portion of the supply, so that the apparatus can be used in a number of applications, including conventional residences, particularly in very cold areas, as well as recreational vehicle camps, campgrounds and the like, where water supply pipes are more exposed. The amount of the water drain can be controlled, as explained above, by varying the size of the drain channels in the filler tube and the pedestal drain element. A typical flow, in the system described above, is one gallon per minute with the supply at a temperature of 56° F.

Although the dimensions of the apparatus described above are configured to be used with a water supply pipe on the order of ½ inch or above, the principles of the present invention are applicable to virtually any size of water supply pipe. The apparatus is operable to very low temperatures, at least 20° F. below zero and even less, and has the advantage of being able to quickly follow the actual temperature cycles of the environment without intervention by the user.

Being completely mechanical, and using the energy of the expanding freezing water to operate, the apparatus uses no external energy, and is completely safe. Should the environment temperature freeze to such an extent, e.g. 60° F. below zero, that all the water in the sample tank freezes, or an accidental blockage occurs, protection against damage to the supply tank is provided by the nut/bolt/spring combinations shown in FIG. 1. The combinations permit the lid to rise from the remainder of the holding tank to the extent necessary to accommodate the ice.

The device is designed so that it may be conveniently cleaned by directing water into the free end of the drain pipe 31, urging the two drain channels in the pedestal drain element. The sample tube 35 can be flushed by directing water through the bleeder valve, forcing water back through the sample tube, the isolation member, the guide tube, through the holding tank and out of the filler tube.

Although a preferred embodiment of the invention has been disclosed herein for purposes of illustration, it should be understood that various changes, modifications and substitutions may be incorporated in such embodiment without departing from the spirit of the invention as defined by the claims which follow. For instance, different metals may be used and various means may be used to secure the parts of the apparatus together. Further, portions of the apparatus, such as the wall 48 surrounding isolation member 43 can be constructed to be separable, for servicing of the apparatus.

What is claimed is:

1. An apparatus for preventing the water in a water supply pipe upstream of the apparatus from freezing, comprising:

sample chamber means filled with water and exposed to the environment, the water in said sample chamber means freezing when the environmental temperature goes below freezing;

drain means for receiving water from the water supply pipe in one portion thereof and for discharging it to the environment from another portion thereof;

means closing off said drain means when the water in said sample chamber means is not frozen;

piston-like means for operating on said closing means to open said drain means in response to the water in said sample chamber means freezing;

means delivering water from the water supply pipe to said drain means when said drain means is open, said delivery means including a holding tank means having said drain means and said closing means located therein;

thermal isolating means, including a first heat sink, between said holding tank means and said sample chamber means;

wherein said piston-like operating means extends through said thermal isolating means, between said sample chamber means and said holding tank, wherein in operation the lower end of the piston moves within said sample chamber means in response to the water therein freezing, which in turn forces the upper end of the piston against said closing means, thereby opening said drain means, wherein a flow of water through the water supply pipe and out said drain means to the environment is maintained as long as the water in said sample chamber means is frozen, such a water flow tending to prevent water in the water supply pipe upstream of the apparatus from freezing.

2. An apparatus of claim 1, wherein said apparatus further includes an exterior thaw tube means connected to said drain means, so that a portion of the water received by said drain means flows through said exterior thaw tube means when said exterior thaw tube means is open, said exterior thaw tube means being positioned so that water flowing from the free end of said exterior thaw tube means is directed into contact with said sample chamber means, which assists in the thawing of the ice in said sample chamber means when the environmental temperature rises above freezing.

3. An apparatus of claim 1, wherein said holding tank means includes inlet means to which the water supply pipe is connected, the inlet means being positioned so that when said drain means is open, water from the water supply pipe flows out the inlet means, aimed at the receiving portion of said drain means.

4. An apparatus of claim 1, including a stub positioned in said sample chamber means, against which the lower end of the piston rests when the water in said sample chamber means is not frozen.

5. An apparatus of claim 1, wherein said thermal isolating means is a tank having a diameter somewhat larger than the diameter of said sample chamber means, wherein said first heat sink is positioned on the lower end of said thermal isolating means, between said thermal isolating means and said sample chamber means, and wherein the apparatus further includes a second heat sink positioned on the upper end of said thermal isolating means, and a block of rubber having a groove in the lower face thereof, positioned within said tank.

6. An apparatus of claim 1, wherein said holding tank includes a spring-held lid which, when water in the holding tank freezes so that the volume of the resulting ice is greater than the volume of the holding tank means, said lid is lifted up against the action of the springs.

7. An apparatus of claim 1, wherein said drain means includes a pedestal element having an opening at the top thereof and two drain channels extending from said opening through said pedestal element, one of said drain channels terminating in a first drain stub exiting from said holding tank, the other of said drain channels terminating in a second drain stub exiting from said holding tank, the apparatus further including a drain pipe which is connected to said first drain stub, wherein said exterior thaw tube is connected to said second drain stub and said inlet means is a filler tube which extends from outside said holding tank, where it is connected to the water supply pipe, into the interior of said holding tank, and includes a small diameter filler channel therein through which water from the water supply pipe flows into the holding tank, aimed at the receiving portion of said drain means, wherein said closing means includes a pivotable plate and means for biasing said pivotable plate against said pedestal element so as to close off said opening at the top thereof.

* * * * *